US005947339A

United States Patent [19]

Boshears et al.

[11] Patent Number: 5,947,339

[45] Date of Patent: Sep. 7, 1999

[54] BEVERAGE DISPENSER

[75] Inventors: Michael B. Boshears, Tulsa, Okla.; Victor L. D. R. Conner, Harrison, Ark.

[73] Assignee: Soda-Flo, Inc., Tulsa, Okla.

[21] Appl. No.: 08/812,642

[22] Filed: Mar. 7, 1997

[51] Int. Cl.[6] ..... B67D 5/06

[52] U.S. Cl. ..... 222/183; 222/135; 222/325; 222/400.8; 222/401

[58] Field of Search ..... 222/129, 135, 222/183, 325, 400.8, 401, 402

[56] References Cited

U.S. PATENT DOCUMENTS

| | | | |
|---|---|---|---|
| 280,798 | 7/1883 | Colcord | 222/400.8 |
| 4,153,181 | 5/1979 | Parker et al. | 222/400.8 |
| 4,928,855 | 5/1990 | Ramsey | 222/131 |
| 5,104,003 | 4/1992 | Stecoza | 222/83.5 |
| 5,118,009 | 6/1992 | Novitsky | 222/1 |
| 5,377,878 | 1/1995 | Rainey et al. | 222/401 |
| 5,385,276 | 1/1995 | Yen-Tang | 222/401 |

FOREIGN PATENT DOCUMENTS

| | | | |
|---|---|---|---|
| 3540984 | 5/1987 | Germany | 222/401 |
| 8911427 | 11/1989 | WIPO | 222/129 |

*Primary Examiner*—Joseph A. Kaufman
*Attorney, Agent, or Firm*—Dunlap, Codding & Rogers, P.C.

[57] ABSTRACT

An apparatus and method for dispensing a beverage from either one of two sizes of beverage bottles. The apparatus includes a base, at least one canister, an adapter cap, a valve assembly, and a pump. The adapter cap has two sets of threads. Typically, one set of threads fits a two liter beverage bottle and the other set of threads mates with a three liter beverage bottle. Further, the adapter cap has both a dispensing port and an injection port, each of which is in fluid communication with the contents of a beverage bottle attached to the adapter cap. A dispensing tube connects the dispensing port of the adapter cap with the valve assembly and an injection tube connects the injection port of the adapter cap with the pump. The canister has a pivotable front portion which may be opened to expose the interior of the canister.

17 Claims, 6 Drawing Sheets

BEVERAGE DISPENSER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates generally to beverage dispensers, and more particularly, but not by way of limitation, to an improved beverage dispenser adapted for dispensing beverages from various sized bottles.

2. Description of Related Art

Carbonated beverages are packaged in many different types and sizes of containers. One particular type of container commonly used to package carbonated beverages is a plastic bottle with a twist off cap. Such bottles are produced in various sizes to provide a single serving or multiple servings. Bottles which contain multiple servings generally come in two and three liter sizes.

While bottles of these sizes are generally more economical, they can also be quite cumbersome to handle, particularly when filled with fluid. Furthermore, when the cap is repeatedly removed from the bottle over a period of time and the beverage is poured from the bottle, the beverage is agitated thereby releasing the carbonation from the beverage. As additional amounts of beverage are poured from the bottle, the carbonation in the beverage is more readily released from the beverage due to the decrease in pressure within the bottle. This release of carbonation results in the beverage having an unfresh or "flat" taste.

In an effort to overcome the drawbacks of purchasing beverages in large bottles, several apparatuses have previously been suggested for dispensing beverages from bottles. For example, U.S. Pat. No. 5,118,009, issued to Novitsky, discloses a beverage dispenser which has a dispensing tube with a puncturing end to pierce the cap of an inverted beverage bottle. The dispenser is shaken to agitate the carbonated beverage to increase pressure and eventually dispense the entire contents of the beverage container.

U.S. Pat. No. 5,240,144, issued to Feldman, discloses a beverage dispensing apparatus which chills and dispenses beverages from an upright beverage bottle. A balloon is inflated to deform the beverage bottle and force the contents out of the bottle.

Another beverage dispenser is disclosed in U.S. Pat. No. 4,928,855, issued to Ramsey. This dispenser includes a base with a dispensing passageway and a bleed passageway. A bushing is mounted in the base for threadingly receiving an inverted beverage bottle. The bushing must be changed out when bottles of different sizes are connected to the dispenser in light of the fact that the diameter of the threaded neck of the bottle varies with the size of the bottle.

While many of the prior art beverage dispensers, including those taught by the above referenced patents, have achieved varying degrees of success, such dispensers are inconvenient to operate, particularly when an individual desires to purchase bottles of different sizes. Furthermore, such dispensers are not capable of repressurizing the interior of the bottle so as to maintain the carbonation, and thus freshness, of the contents in the bottle.

SUMMARY OF THE INVENTION

The present invention is directed to a beverage dispenser that is adapted to receive bottles of different sizes and to prolong the freshness of the contents of the bottle. The present invention includes a canister supported on a base. The canister defines a bottle receiving space which is sized to encompass a bottle in an inverted position. The beverage dispenser further includes an adapter cap that has a fluid flow passageway extending therethrough, a first collar portion having internally disposed threads for threaded engagement with the threaded neck of a first bottle, and a second collar portion having internally disposed threads for threaded engagement with the threaded neck of a second bottle wherein the threaded neck of the second bottle is greater than the threaded neck of the first bottle. The fluid flow passageway of the adapter cap includes a fluid outlet port and an air injection port. A pump is connected to the air injection port of the adapter cap for injecting air into the bottle threadingly attached to the adapter cap via the fluid flow passageway so as to increase pressure in the bottle. A valve assembly is connected to the fluid outlet port of the adapter cap for selectively dispensing the contents of the bottle threadingly attached to the adapter cap through the fluid outlet port of the adapter cap.

In another aspect, the present invention is directed to a method of dispensing a carbonated beverage from a bottle having a threaded neck. The method comprises the steps of: (a) threadingly attaching an adapter cap to the threaded neck of the bottle such that the contents of the bottle are in fluid communication with a fluid flow passageway extending through the adapter cap; (b) selectively dispensing the beverage from the bottle via the fluid flow passageway of the adapter cap; and (c) introducing a volume of air into the bottle subsequent to dispensing the beverage from the bottle so as to increase the pressure in the bottle and thereby maintain the carbonation of the beverage in solution.

The objects, features and advantages of the present invention will become apparent from the following detailed description when read in conjunction with the accompanying drawings and appended claims.

DETAILED DESCRIPTION OF THE INVENTION

Figure 1:
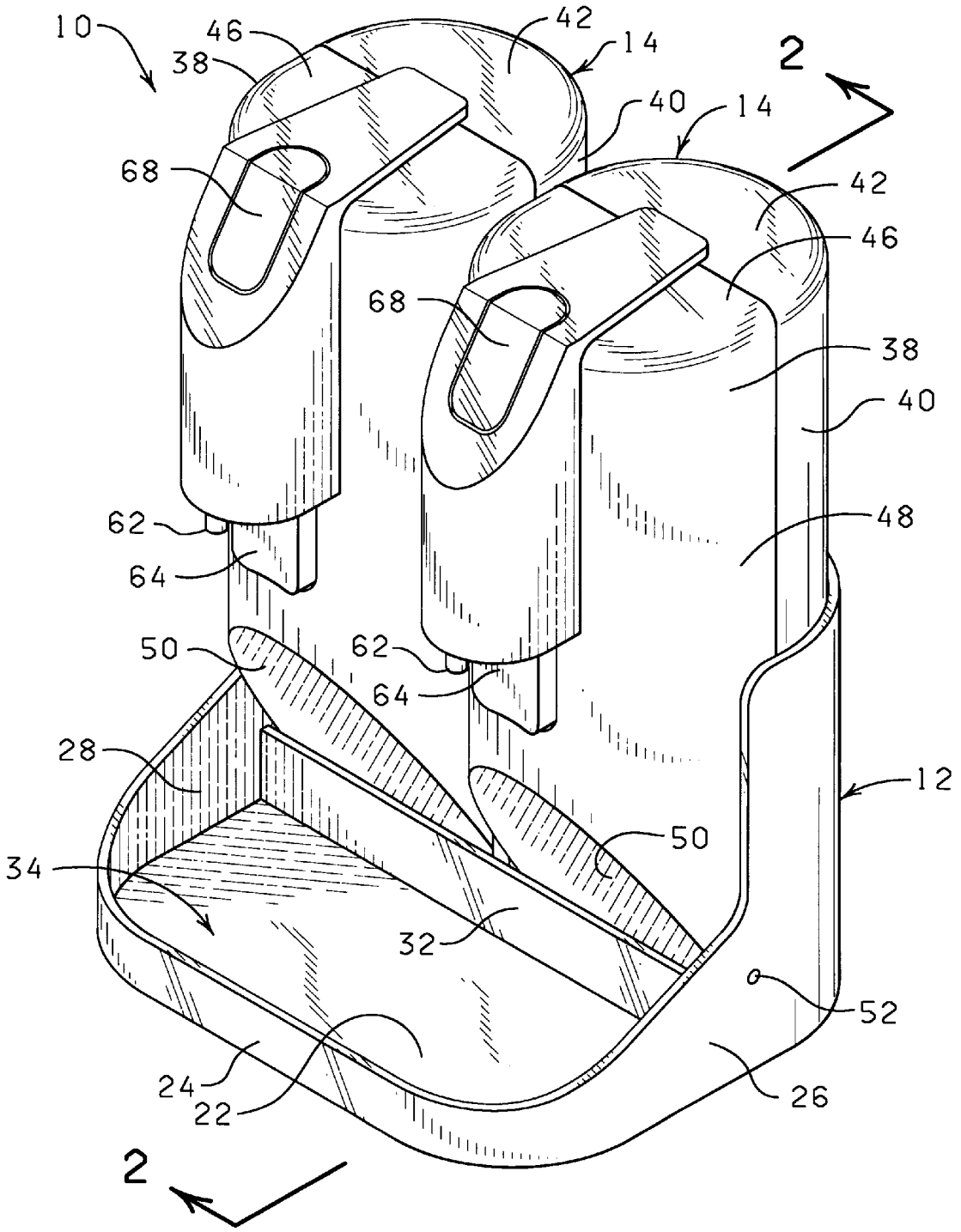
FIG. 1 is a perspective view of a beverage dispenser constructed in accordance with the present invention.
Figure 2:
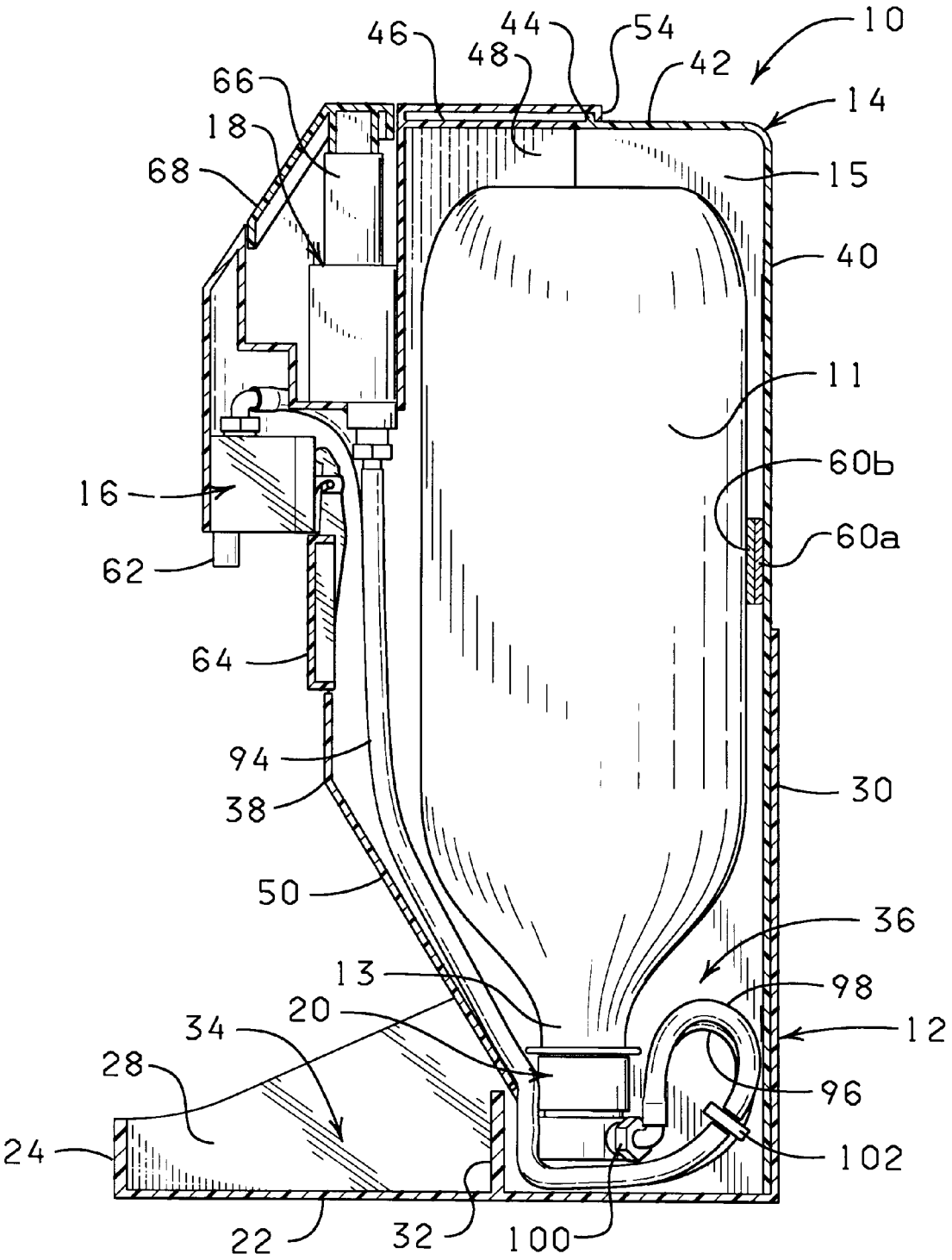
FIG. 2 is a partial cross sectional view taken along lines 2—2 of FIG. 1.

Referring now to the drawings, and more particularly to FIGS. 1 and 2, a beverage dispenser 10 constructed in accordance with the present invention is shown with a bottle 11 (FIG. 2) disposed therein and operably connected to the beverage dispenser 10 for selectively dispensing the contents of the bottle 11. The bottle 11 represents a conventional beverage bottle having a threaded neck 13 (FIG. 2). As mentioned above, beverage bottles, such as the one depicted in FIG. 2, are available in various sizes, with two liters and three liters being the most common sizes for providing multiple servings.

The beverage dispenser 10 includes a base 12 and a pair of canisters 14. The base 12 and each canister 14 cooperate to define a bottle receiving space 15. As shown in FIG. 2, each canister 14 supports a valve assembly 16, a pump 18, and an adapter cap 20.

The base 12 is characterized as having a bottom 22, a front wall 24, side walls 26 and 28, a rear wall 30, and a dividing rib 32. The front wall 24 is substantially lower than the rear wall 30 and the height of the side walls 26 and 28 is increased from the front wall 24 to the rear wall 30.

The dividing rib 32 extends across the base 12 from side wall 26 to side wall 28 to separate the base 12 into two sections, a front section 34 and a rear section 36, whereby the front section 34 of the base 12 serves as a drip tray and the rear section 36 of the base 12 defines a lower portion of a beverage container area. As best shown in FIG. 2, the dividing rib 32 is about the same height as the front wall 24.

The rear wall 30 is generally in the shape of two half-cylinders. With this construction, the rear wall 30 of the base 12 substantially conforms to and extends around the rear half of each of the canisters 14.

Each of the canisters 14 comprises a front section 38 and rear section 40. The rear section 40 of each canister 14 is secured to the corresponding conforming area of the rear wall 30 of the base 12. The rear sections 40 may be molded with the base 12, or may be attached with adhesive or any other means known in the art. The rear section 40 further has a top portion 42. Protruding upward from a forward area of the top portion 42 is a closure nub 44.

Figure 3:
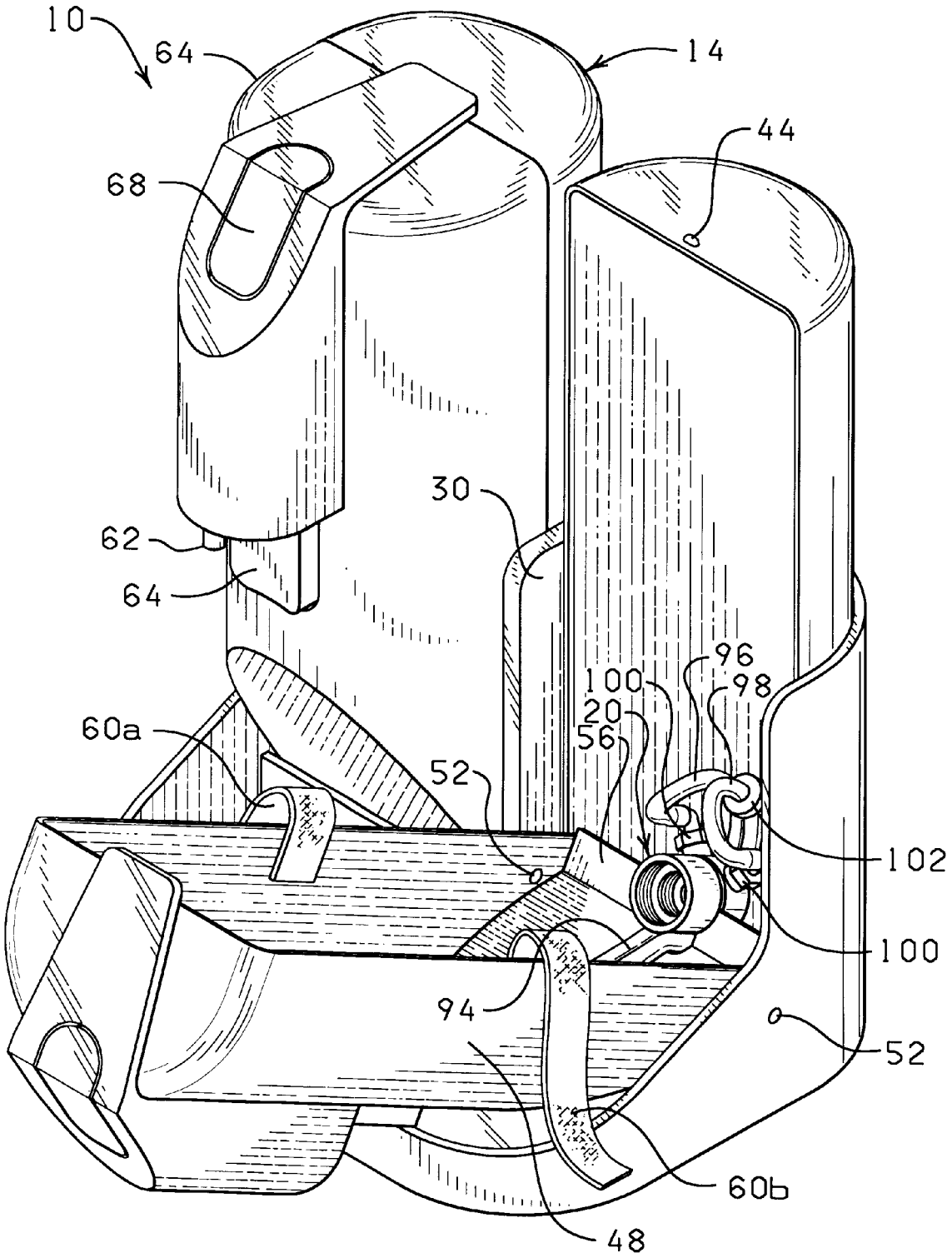
FIG. 3 is a perspective view of the beverage dispenser of the present invention shown with one front housing portion pivoted open to receive a beverage container.
Figure 4:
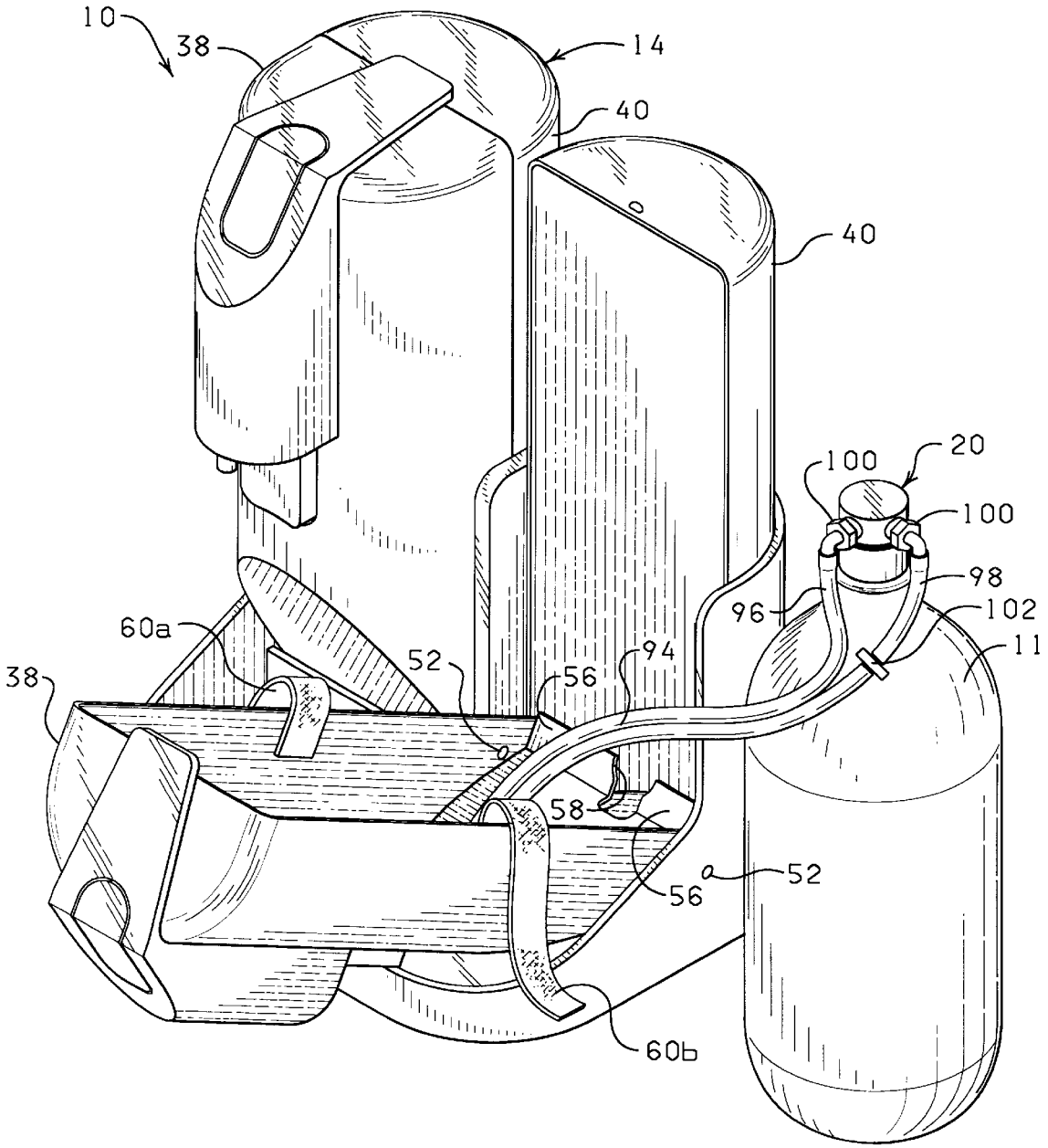
FIG. 4 is a perspective view of the beverage dispenser of the present invention shown with a beverage bottle positioned outside the dispenser and the adapter cap threadingly attached to the bottle.
Figure 5:
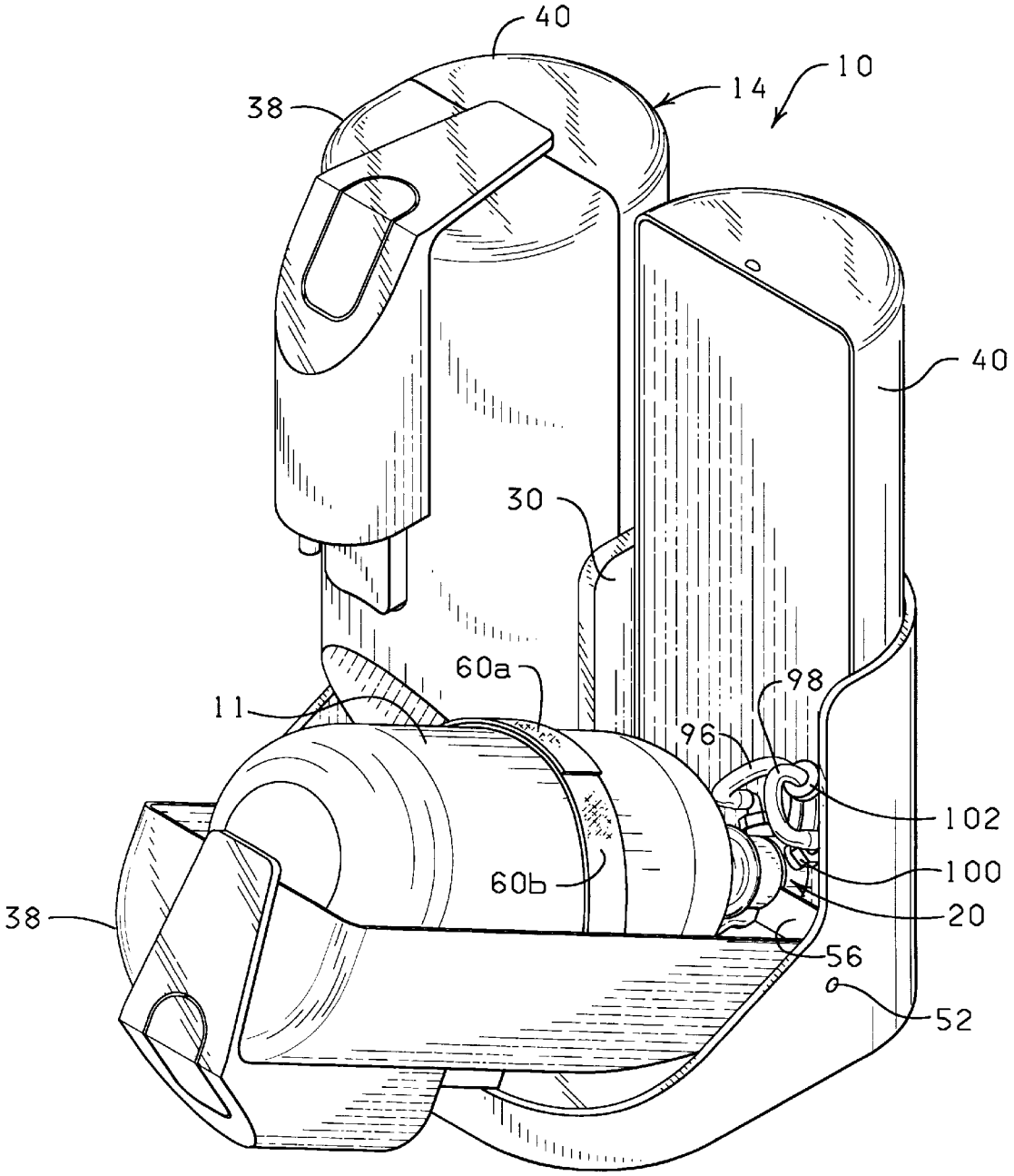
FIG. 5 is a perspective view of the beverage dispenser of the present invention shown with one front housing portion pivoted open and the beverage bottle positioned in the front housing portion of the beverage dispenser.

The front section 38 of each canister 14 includes a top portion 46, a semi-cylindrical side wall 48, and an angular lower wall 50. As best illustrated in FIGS. 3-5, the front section 38 of each canister 14 is pivotally mounted to the base 12 at a pair of pivot points 52. Thus, the front section 38 of each canister 14 may be pivoted forward and downward to expose the interior of the canister 14.

The top portion 46 of the front section 38 is provided with an overhanging lip 54. It should be appreciated that the overhanging lip 54 may be a recess, a slot, a loop or any type of opening which is capable of cooperating with the closure nub 44 of the rear section 40 to maintain the front section 38 in a closed relationship with the rear section 40.

As best shown in FIGS. 3–5, a flange 56 extends angularly inward from the lower wall 50 of each canister 14. The flange 56 is provided with an adapter cap receiving slot 58. The adapter cap receiving slot 58 is sized and shaped to receive the adapter cap 20 and to allow a double tube to extend therethrough from the lower area of the canister 14 to the valve assembly 16 and the pump 18, in a manner to be described in greater detail below. It should be appreciated that the flange 56 of each canister 14 is configured to support the adapter cap 20 and a beverage bottle in a substantially inverted position when the canister 14 is closed.

To secure a beverage bottle in the canister 14, a pair of hook and loop securing straps 60*a* and 60*b* are attached to the wall of the front section 38 of each canister 14. Typically, the securing straps 60*a* and 60*b* are located at a point between the middle and the top of the corresponding canister 14 to hold the upper portion of the beverage bottle stationary.

As shown in FIG. 2, the valve assembly 16 is mounted to the canister 14. The valve assembly 16 allows the contents of the beverage bottle 11 to be selectively dispensed therefrom in a manner to be discussed in greater detail below. The valve assembly 16 includes a nozzle 62.and a lever 64. A suitable valve assembly 16 is disclosed in U.S. Pat. No. 4,753,277, issued to Holcomb et al., which is hereby incorporated by reference. It will be appreciated, however, that a wide range of conventional flow control valves may be utilized with the present invention.

The pump 18 permits air to be injected into the beverage bottle 11 via the adapter cap 20 to increase the pressure in the beverage bottle 11. The pump 18 has a plunger 66 and a push button 68. A suitable pump 18 is disclosed in U.S. Pat. No. 2,060,512, issued to Magill, which is hereby incorporated by reference. It will be appreciated, however, that any appropriate mechanical pump known in the art may be utilized for injecting air into the bottle 11. Further, an electrical pump or a suitably controlled cylinder of pressurized gas may be substituted for the mechanical pump 18.

Figure 6:
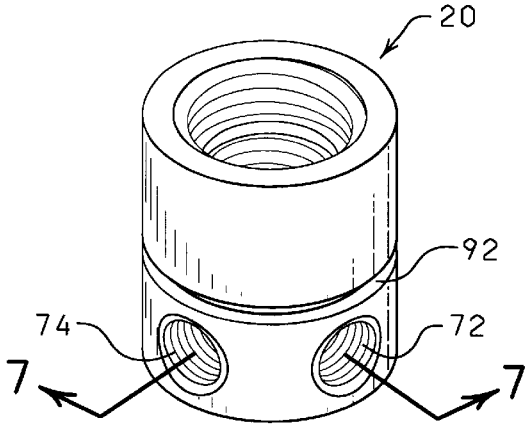
FIG. 6 is a perspective view of an adapter cap of the beverage dispenser.
Figure 7:
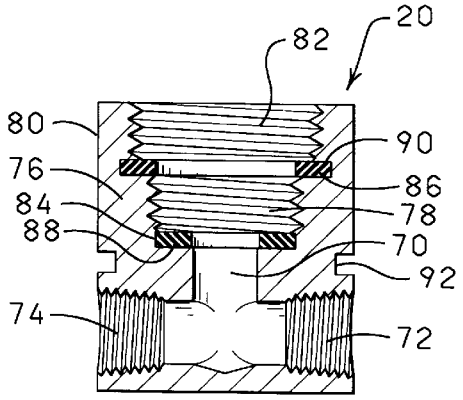
FIG. 7 is a cross sectional view taken along lines 7—7 of FIG. 6.

FIGS. 6 and 7 show the adapter cap 20 in greater detail. The adapter cap 20 is a generally cylindrically shaped member having a fluid flow passageway 70 extending therethrough. The fluid flow passageway 70 includes a threaded fluid outlet port 72 and a threaded air injection port 74. As illustrated in FIG. 6, the outlet port 72 and the injection port 74 are formed at an angular relationship to one another. However, it will be appreciated that the outlet port 72 and the injection port 74 may be set in a variety of arrangements so long as the outlet port 72 is in fluid communication with the injection port 74.

To effect attachment of the adapter cap 20 to the beverage bottle 11, the adapter cap 20 is provided with a first collar portion 76 having internally disposed threads 78 for threaded engagement with the threaded neck 13 of the beverage bottle 11 such that the contents of the bottle 11 are in fluid communication with the fluid flow passageway 70 of the adapter cap 20 when the bottle 11 is threadingly attached to the first collar portion 76. The adapter cap 20 is further provided with a second collar portion 80 having internally disposed threads 82 for threaded engagement with the threaded neck of another beverage bottle having a threaded neck different in diameter than the threaded neck of the bottle 11 such that the contents of the second bottle are in fluid communication with the fluid flow passageway 70 of the adapter cap 20 when the second bottle is threadingly attached to the second collar portion 80.

In the adapter cap 20 illustrated in FIGS. 6 and 7, the second collar portion 80 has an internal diameter greater than the internal diameter of the first collar portion 76 and the second collar portion 80 extends from the first collar portion 76 in a concentric relationship. More specifically, in a preferred embodiment, the first collar portion 76 is dimensioned to threadingly mate with the threaded neck of a conventional two liter beverage bottle and the second collar portion 80 is dimensioned to threadingly mate with the threaded neck of a conventional three liter beverage bottle.

The first and second collar portions 76 and 80 define a first annular recess 84 and a second annular recess 86, respectively. A first seal member 88 is positioned in the first annular recess 84 for effecting a substantially fluid tight seal between the bottle 11 and the adapter cap 20 when the bottle 11 is threadingly attached to the first collar portion 76, and a second seal member 90 is positioned in the second annular recess 86 for effecting a substantially fluid tight seal between the second bottle and the adapter cap 20 when the second bottle is threadingly attached to the second collar portion 80.

As such, the beverage dispenser 10 is able to accommodate a two liter bottle or a three liter bottle without requiring modification to the beverage dispenser 10.

To facilitate attachment of the adapter cap 20 to the flange 56 of the canister 14, the adapter cap 20 is provided with an external annular groove 92 which is supportingly matable with the adapter cap receiving slot 58 of the flange 56.

Figure 8:
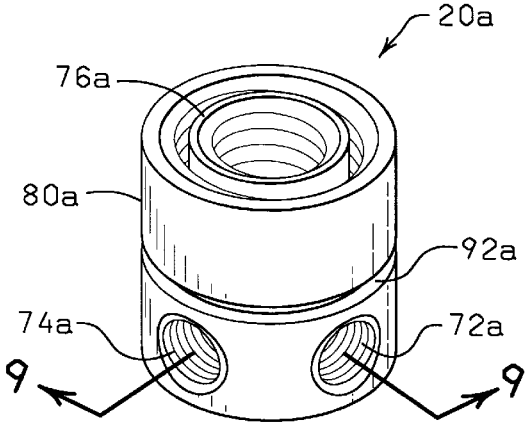
FIG. 8 is a perspective view of another embodiment of an adapter cap of the beverage dispenser.
Figure 9:
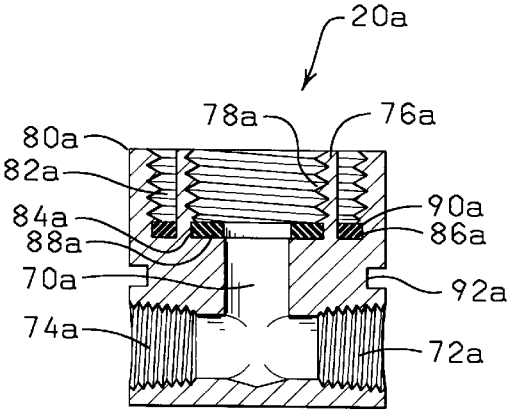
FIG. 9 is a cross sectional view taken along lines 9—9 of FIG. 8.

FIGS. 8 and 9 illustrate another embodiment of an adapter cap 20*a*. It will be appreciated that the adapter cap 20*a* is substantially similar in construction to the adapter cap 20 except as noted below.

The adapter cap 20*a* is provided with a first collar portion 76*a* having internally disposed threads 78*a* for threaded engagement with the threaded neck 13 of the beverage bottle 11 such that the contents of the bottle 11 are in fluid communication with the fluid flow passageway 70*a* of the adapter cap 20*a* when the bottle 11 is threadingly attached to the first collar portion 76*a*. The adapter cap 20*a* is further provided with a second collar portion 80*a* having internally disposed threads 82*b* for threaded engagement with the threaded neck of another beverage bottle having a threaded neck different in diameter than the threaded neck of the bottle 11 such that the contents of the second bottle are in fluid communication with the fluid flow passageway 70*a* of the adapter cap 20*a* when the second bottle is threadingly attached to the second collar portion 80*a*.

Like the second collar portion 80 of the adapter cap 20, the second collar portion 80*a* of the adapter cap 20*a* has an internal diameter greater than the internal diameter of the first collar portion 76*a*, and the second collar portion 80*a* is arranged in a concentric relationship relative to the first collar portion 76*a*. However, the first collar portion 76*a* and the second collar portion 80*a* are formed so that the first collar portion 76*a* is nested within the second collar portion 80*a*. Like the adapter cap 20, the first collar portion 76*a* is dimensioned to threadingly mate with the threaded neck of a conventional two liter beverage bottle and the second collar portion 80*a* is dimensioned to threadingly mate with the threaded neck of a conventional three liter beverage bottle.

The first and second collar portions 76*a* and 80*a* define a first annular recess 84*a* and a second annular recess 86*a*, respectively. A first seal member 88*a* is positioned in the first annular recess 84*a* for effecting a substantially fluid tight seal between the bottle 11 and the adapter cap 20*a* when the bottle 11 is threadingly attached to the first collar portion 76*a*, and a second seal member 90*a* is positioned in the second annular recess 86*a* for effecting a substantially fluid tight seal between the second bottle and the adapter cap 20*a* when the second bottle is threadingly attached to the second collar portion 80*a*. Due to the configuration of the first and second collar portions 76*a* and 80*a*, it will be appreciated that the first seal member 88*a* is positioned in a coplanar relationship relative to the second seal member 90*a*.

The nested configuration of the first and second collar portions 76*a* and 80*a* of the adapter cap 20*a* not only provides the advantage of being able to accommodate a two liter bottle or a three liter bottle without requiring modification to the beverage dispenser 10, but the nested configuration of the adapter cap 20*a* also provides the advantage of decreasing the overall height of the adapter cap 20*a*. Thus, the base 12 and canisters 14 are capable of being sized to accommodate two and three liter bottles and fit on a counter top beneath a cabinet spaced above the counter top a conventional height, which is generally about 18 inches.

Returning to FIG. 2, the valve assembly 16 and the pump 18 are interconnected with the adapter cap 20 with a suitable tubing 94 that includes a dispensing tube 96 and an injection tube 98 joined in a parallel relationship. The tubing 94 illustrated herein is a double tubing split at both ends to separate the dispensing tube 96 and the injection tube 98. One end of the dispensing tube 96 is connected to the valve assembly 16 and the other end of the dispensing tube 96 is connected to the outlet port 72 of the adapter cap 20. Similarly, one end of the injection tube 98 is connected to the pump 18 and the other end of the injection tube 98 is connected to the injection port 74 of the adapter cap 20. To facilitate connecting the dispensing tube 96 and the injection tube 98 to the adapter cap 20, elbow fittings 100 are utilized.

It should be appreciated that two separate single tubes may be used for the dispensing tube 96 and the injection tube 98 instead of the double tubing 94. Further, it should be appreciated that the double tubing 94 or separate tubes may extend from the adapter cap 20 to the valve assembly 16 and the pump 18 in any manner consistent with the purpose of the present invention.

It is desirable to prevent flow of the liquid from the beverage bottle through the injection tube 98 toward the pump 18. Therefore, a check valve 102 is installed in the injection tube 98 near the adapter cap 20. In this manner, air is allowed to flow from the pump 18 into the beverage bottle 11, but the check valve 102 prevents liquid flow in the opposite direction. In an alternative embodiment, the check valve 102 may be provided as an integral component of the pump 18.

In use, the bottle cap is removed from the beverage bottle and the selected canister 14 is opened as illustrated in FIG. 3. The bottle is placed upright alongside the open canister 14. The adapter cap 20 is next removed from the flange 56 of the open canister 14 and placed onto the threaded neck of the bottle 11 (FIG. 4). The bottle 11 is then carefully rotated to screw the threaded neck of the bottle into threaded engagement with the appropriate sized collar portion 76 or 80 of the adapter cap 20.

The adapter cap 20 and bottle 11 are then placed into the open canister 14, with the groove 92 of the adapter cap 20 receiving the flange 56 of the canister 14 (FIG. 5). The double tubing 94 and the adapter cap 20 are disposed in the adapter cap receiving slot 58, with the double tubing 94 running through the adapter cap receiving slot 58 in front of the adapter cap 20. The securing straps 60*a* and 60*b* are then fastened about the beverage bottle 11.

Finally, the front section 38 of the canister 14 is pivoted to close the canister 14. In closing the canister 14, the front section 38 is lifted and the lip 54 of the front section 38 is disposed over the closure nub 44 of the rear section 40. With the canister 14 closed, the closure nub 44 and the lip 54 cooperate to keep the canister 14 closed, and the flange 56 supports the adapter cap 20 and the bottle 11 in an inverted upright position, as shown in FIG. 2. The beverage dispenser 10 is ready for dispensing the contents of the bottle 11.

To dispense the contents of the bottle, a container is held under the nozzle 62 and engaged against the lever 64 of the valve assembly 16 so as to cause the liquid in the bottle 11 to flow from the bottle 11 through the dispensing tube 96, the valve assembly 16 and the nozzle 62 and into the cup (not shown). To terminate the flow of liquid from the nozzle 62, the lever 64 is disengaged.

The pump 18 may be periodically utilized to increase pressure in the bottle 11. By depressing the push button 68, the pump 18 injects air through the injection tube 98 and the adapter cap 20 and into the beverage bottle 11. By increasing pressure within the beverage bottle 11, the ease of dispensing the bottle contents is enhanced. In addition, in the case of carbonated beverages, proper carbonation of the bottle contents is prolonged. That is, the introduction of air into the bottle 11 results in a gaseous equilibrium which prevents the carbon dioxide from readily coming out of solution and filling the void in the bottle 11 created by the dispensed beverage. To this end, it has been found that the introduction of air into the bottle 11 immediately after dispensing an amount of beverage from the bottle 11 significantly prolongs the freshness of carbonated beverages.

The present invention is particularly suitable for keeping and dispensing carbonated beverages. However, it should be appreciated that the dispensing apparatus disclosed herein may be used to keep and dispense a wide variety of non-carbonated beverages, as well as other types of liquids.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A beverage dispenser, comprising:

a base;

a canister supported on the base and defining a bottle receiving space having an upper end and a lower end;

an adapter cap supported in the lower end of the bottle receiving space such that the adapter cap is threadingly engagable with a first beverage bottle when the first beverage bottle is disposed in the bottle receiving space in an inverted position and with a second beverage bottle when the second beverage bottle is disposed in the bottle receiving space in an inverted position, the adapter cap having a fluid flow passageway extending therethrough, a first collar portion having internally disposed threads for threaded engagement with the first beverage bottle having a threaded neck such that the contents of the first beverage bottle are in fluid communication with the fluid flow passageway of the adapter cap when the first beverage bottle is threadingly attached to the first collar portion and disposed in the bottle receiving space in an inverted position, and a second collar portion having internally disposed threads for threaded engagement with the second beverage bottle having a threaded neck such that the contents of the second beverage bottle are in fluid communication with the fluid flow passageway of the adapter cap when the second beverage bottle is threadingly attached to the second collar portion and disposed in the bottle receiving space in an inverted position, the diameter of the first collar portion being less than the diameter of the second collar portion; and a valve supported on the canister and connected to the adapter cap so as to be in fluid communication with the fluid flow passageway thereof, for selectively dispensing the contents of the beverage bottle disposed in the bottle receiving space and threadingly attached to the adapter cap through the fluid flow passageway of the adapter cap.

2. The beverage dispenser of claim 1 wherein the first collar portion of the adapter cap is concentrically disposed relative to the second collar portion of the adapter cap.

3. The beverage dispenser of claim 1 wherein the adapter cap has a first annular recess and a second annular recess, the second annular recess defined by the first collar portion and the second collar portion, and wherein the adapter cap further includes a first seal member positioned in the first annular recess for effecting a substantially fluid tight seal between the first bottle and the adapter cap when the first bottle is threadingly attached to the first collar portion and a second seal member positioned in the second annular recess for effecting a substantially fluid tight seal between the second bottle and the adapter cap when the second bottle is threadingly attached to the second collar portion.

4. The beverage dispenser of claim 3 wherein the first seal member is concentrically positioned relative to the second seal member.

5. The beverage dispenser of claim 4 wherein the first seal member is positioned in a coplanar relationship relative to the second seal member.

6. The beverage dispenser of claim 1 wherein the first collar portion is sized to be threadingly engagable with a threaded neck of a conventional two liter beverage bottle and wherein the second collar portion is sized to be threadingly engagable with a threaded neck of a conventional three liter beverage bottle.

7. The beverage dispenser of claim 1 wherein the canister is provided with a flange having a cap receiving slot, and wherein the adapter cap is provided with an external groove which is supportingly matable with the cap receiving slot.

8. The beverage dispenser of claim 1 wherein the canister has a front section and a rear section, the rear section of the canister being secured to the base and the front section of the canister being pivotably mounted to the rear section for selectively opening and closing the canister.

9. The beverage dispenser of claim 1 wherein the fluid flow passageway of the adapter cap has a fluid outlet port and an air injection port, the fluid outlet port being in fluid communication with the air injection port, and wherein the beverage dispenser further comprises:

pump means connected to the air injection port of the adapter cap for injecting air into the bottle threadingly attached to the adapter cap via the fluid flow passageway so as to increase the pressure in the bottle.

10. A beverage dispenser, comprising:

a base;

a canister supported on the base and defining a bottle receiving space having an upper end and a lower end;

an adapter cap supported in the lower end of the bottle receiving space such that the adapter cap is threadingly engagable with a first beverage bottle when the first beverage bottle is disposed in the bottle receiving space in an inverted position and with a second beverage bottle when the second beverage bottle is disposed in the bottle receiving space in an inverted position, the adapter cap having a fluid flow passageway extending therethrough, a first collar portion having internally disposed threads for threaded engagement with the first beverage bottle having a threaded neck such that the contents of the first beverage bottle are in fluid communication with the fluid flow passageway of the adapter cap when the first beverage bottle is threadingly attached to the first collar portion and disposed in the bottle receiving space in an inverted position, and a second collar portion having internally disposed threads for threaded engagement with the second beverage bottle having a threaded neck such that the contents of the second beverage bottle are in fluid communication with the fluid flow passageway of the adapter cap when the second beverage bottle is threadingly attached to the second collar portion and disposed in the bottle receiving space in an inverted position, the diameter of the first collar portion being less than the diameter of the second collar portion, the fluid flow passageway having a fluid outlet port and an air injection port, the fluid outlet port being in fluid communication with the air injection port;

pump means connected to the air injection port of the adapter cap for injecting air into the beverage bottle threadingly attached to the adapter cap via the fluid flow passageway so as to increase the pressure in the beverage bottle; and a valve supported on the canister and connected to the adapter cap so as to be in fluid communication with the fluid flow passageway thereof, for selectively dispensing the contents of the beverage bottle disposed in the bottle receiving space and threadingly attached to the adapter cap through the fluid outlet port of the adapter cap.

11. The beverage dispenser of claim 10 wherein the first collar portion of the adapter cap is concentrically disposed relative to the second collar portion of the adapter cap.

12. The beverage dispenser of claim 10 wherein the adapter cap has a first annular recess and a second annular recess, the second annular recess defined by the first collar portion and the second collar portion, and wherein the adapter cap further includes a first seal member positioned in the first annular recess for effecting a substantially fluid tight seal between the first bottle and the adapter cap when the first bottle is threadingly attached to the first collar portion and a second seal member positioned in the second annular recess for effecting a substantially fluid tight seal between the second bottle and the adapter cap when the second bottle is threadingly attached to the second collar portion.

13. The beverage dispenser of claim 12 wherein the first seal member is concentrically positioned relative to the second seal member.

14. The beverage dispenser of claim 13 wherein the first seal member is positioned in a coplanar relationship relative to the second seal member.

15. The beverage dispenser of claim 10 wherein the first collar portion is sized to be threadingly engagable with a threaded neck of a conventional two liter beverage bottle and wherein the second collar portion is sized to be threadingly engagable with a threaded neck of a conventional three liter beverage bottle.

16. The beverage dispenser of claim 10 wherein the canister is provided with a flange having a cap receiving slot, and wherein the adapter cap is provided with an external groove which is supportingly matable with the cap receiving slot.

17. The beverage dispenser of claim 10 wherein the canister has a front section and a rear section, the rear section of the canister being secured to the base and the front section of the canister being pivotably mounted to the rear section for selectively opening and closing the canister.

* * * * *